US009837047B2

(12) United States Patent
Chu Ke et al.

(10) Patent No.: US 9,837,047 B2
(45) Date of Patent: Dec. 5, 2017

(54) FLAT PANEL DISPLAY HAVING DYNAMIC ADJUSTMENT MECHANISM AND IMAGE DISPLAY METHOD THEREOF

(75) Inventors: Hui Chu Ke, Hsin-Chu (TW); Sheng-Wen Cheng, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 1855 days.

(21) Appl. No.: 12/888,435

(22) Filed: Sep. 23, 2010

(65) Prior Publication Data

US 2011/0090260 A1 Apr. 21, 2011

(30) Foreign Application Priority Data

Oct. 16, 2009 (TW) ..... 098135098 A

(51) Int. Cl.
*G09G 5/02* (2006.01)
*G09G 5/06* (2006.01)

(52) U.S. Cl.
CPC ..... *G09G 5/06* (2013.01); *G09G 2300/0452* (2013.01); *G09G 2320/064* (2013.01); *G09G 2320/0646* (2013.01)

(58) Field of Classification Search
CPC ..... G09G 5/02; G09G 2300/0452; G09G 2320/0452; G09G 2320/064; G09G 2320/0646
USPC ..... 345/690–691
See application file for complete search history.

(56) References Cited

U.S. PATENT DOCUMENTS

| | | | | |
|---|---|---|---|---|
| 6,947,589 | B2 | 9/2005 | Newman | |
| 8,144,141 | B2 * | 3/2012 | Hirose et al. | 345/209 |
| 8,199,101 | B2 | 6/2012 | Aoki | |
| 2004/0046725 | A1 | 3/2004 | Lee | |
| 2006/0050033 | A1 * | 3/2006 | Asao | G09G 3/3607 345/88 |
| 2007/0152949 | A1 * | 7/2007 | Sakai | 345/102 |
| 2007/0182682 | A1 | 8/2007 | Hong | |
| 2007/0279372 | A1 | 12/2007 | Brown Elliott | |
| 2008/0158454 | A1 * | 7/2008 | Shin et al. | 349/36 |
| 2008/0297461 | A1 | 12/2008 | Hsu | |
| 2009/0002298 | A1 * | 1/2009 | Furukawa | 345/88 |
| 2010/0060670 | A1 * | 3/2010 | Kuo | G09G 5/02 345/690 |

(Continued)

FOREIGN PATENT DOCUMENTS

| | | |
|---|---|---|
| TW | 200405082 | 4/2004 |
| TW | 200834531 | 8/2008 |

*Primary Examiner* — Kwin Xie
(74) *Attorney, Agent, or Firm* — WPAT, PC

(57) ABSTRACT

A flat panel display includes a four-color conversion unit, a backlight control unit, a backlight module, and a pixel array. The four-color conversion unit provides a first set of four color image signals corresponding to three color image input signals based on a preliminary conversion lookup table and provides corresponding conversion scaling factors. The backlight control unit generates a backlight adjusting factor based on the conversion scaling factors. The backlight module provides a backlight output having an intensity adjusted according to the backlight adjusting factor. The four-color conversion unit further provides a second set of four color image signals corresponding to the three color image input signals based on the backlight adjusting factor. The pixel array displays an image according to the second set of four color image signals and the backlight output.

21 Claims, 4 Drawing Sheets

(56) References Cited

U.S. PATENT DOCUMENTS

2010/0321414 A1* 12/2010 Muroi et al. ..... 345/690

* cited by examiner

FLAT PANEL DISPLAY HAVING DYNAMIC ADJUSTMENT MECHANISM AND IMAGE DISPLAY METHOD THEREOF

BACKGROUND OF THE INVENTION

1. Field of the Invention

The present invention relates to a flat panel display and an image display method thereof, and more particularly, to a flat panel display having dynamic adjustment mechanism and an image display method thereof.

2. Description of the Prior Art

Along with the advantages of thin appearance, low power consumption, and low radiation, flat panel displays (FPDs) have been widely applied in various electronic products such as computer monitors, mobile phones, personal digital assistants (PDAs), or flat-panel televisions. Among existing flat panel displays, liquid crystal displays have gained higher popularity because of lower power consumption. Traditional liquid crystal display employs a three-color display technology based on RBG pixels to illustrate colors. However, while displaying images having high brightness, the performance of traditional liquid crystal display is unsatisfied. With the aim of enhancing image brightness, a four-color display technology is developed to illustrate colors based on RBGW pixels having white-color pixels. As the display technology of a liquid crystal display is switching from the three-color display technology to the four-color display technology, the areas available for disposing RGB pixels are reduced because of adding white-color pixels. For that reason, the liquid crystal display is incapable of accurately illustrating desirable brightness and chroma of the colors which are pure colors or close to pure colors. Furthermore, since the addition of white-color pixels causes lower brightness and chroma of the colors which are pure colors or close to pure colors, it is hard to achieve high reproducibility of images displayed based on the four-color display technology.

SUMMARY OF THE INVENTION

In accordance with one embodiment of the present invention, a flat panel display having dynamic adjustment mechanism is provided for achieving high reproducibility of images displayed based on four color image signals. The flat panel display comprises a four-color conversion unit, a dynamic backlight control unit, a backlight module, a source driver, and a pixel array unit. The four-color conversion unit comprises a preliminary conversion lookup table. The four-color conversion unit is utilized for providing a first set of four color image signals corresponding to three color image input signals based on the preliminary conversion lookup table and providing a plurality of corresponding conversion scaling factors. Further, the four-color conversion unit is employed to convert the three color image input signals into a second set of four color image signals according to a backlight adjusting signal. The dynamic backlight control unit, electrically connected to the four-color conversion unit, is utilized for generating the backlight adjusting signal according to the conversion scaling factors. The backlight module, electrically connected to the dynamic backlight control unit, functions to provide a backlight output having an intensity adjusted according to the backlight adjusting signal. The source driver, electrically connected to the four-color conversion unit, is employed to provide a plurality of data signals based on the second set of four color image signals. The pixel array unit, electrically connected to the source driver, is put in use for displaying an image according to the data signals in coordination with the backlight output.

In accordance with another embodiment of the present invention, a flat panel display having dynamic adjustment mechanism is provided for achieving high reproducibility of images displayed based on four color image signals. The flat panel display comprises a four-color conversion unit, a dynamic backlight control unit, a compensation unit, a backlight module, a source driver, and a pixel array unit. The four-color conversion unit comprises a preliminary conversion lookup table. The four-color conversion unit is utilized for providing a first set of four color image signals corresponding to three color image input signals based on the preliminary conversion lookup table and providing a plurality of corresponding conversion scaling factors. The dynamic backlight control unit, electrically connected to the four-color conversion unit, is utilized for generating a backlight adjusting signal according to the conversion scaling factors. The compensation unit, electrically connected to the four-color conversion unit and the dynamic backlight control unit, is utilized for compensating the first set of four color image signals to become a second set of four color image signals according to the backlight adjusting signal. The backlight module, electrically connected to the dynamic backlight control unit, functions to provide a backlight output having an intensity adjusted according to the backlight adjusting signal. The source driver, electrically connected to the compensation unit, is employed to provide a plurality of data signals based on the second set of four color image signals. The pixel array unit, electrically connected to the source driver, is put in use for displaying an image according to the data signals in coordination with the backlight output.

The present invention further provides an image display method for use in a flat panel display for achieving high reproducibility of images displayed based on four color image signals. The image display method comprises: receiving a set of three color image input signals; providing a first set of four color image signals corresponding to the set of three color image input signals based on a preliminary conversion lookup table and providing a plurality of corresponding conversion scaling factors; providing a backlight adjusting signal according to the conversion scaling factors; adjusting the intensity of a backlight output according to the backlight adjusting signal; generating a second set of four color image signals according to the backlight adjusting signal; and displaying an image according to the second set of four color image signals in coordination with the backlight output.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, preferred embodiments of the present invention will be described in detail with reference to the accompanying drawings. Here, it is to be noted that the present invention is not limited thereto. Furthermore, the step serial numbers regarding the image display method are not meant thereto limit the operating sequence, and any rearrangement of the operating sequence for achieving same functionality is still within the spirit and scope of the invention.

Figure 1:
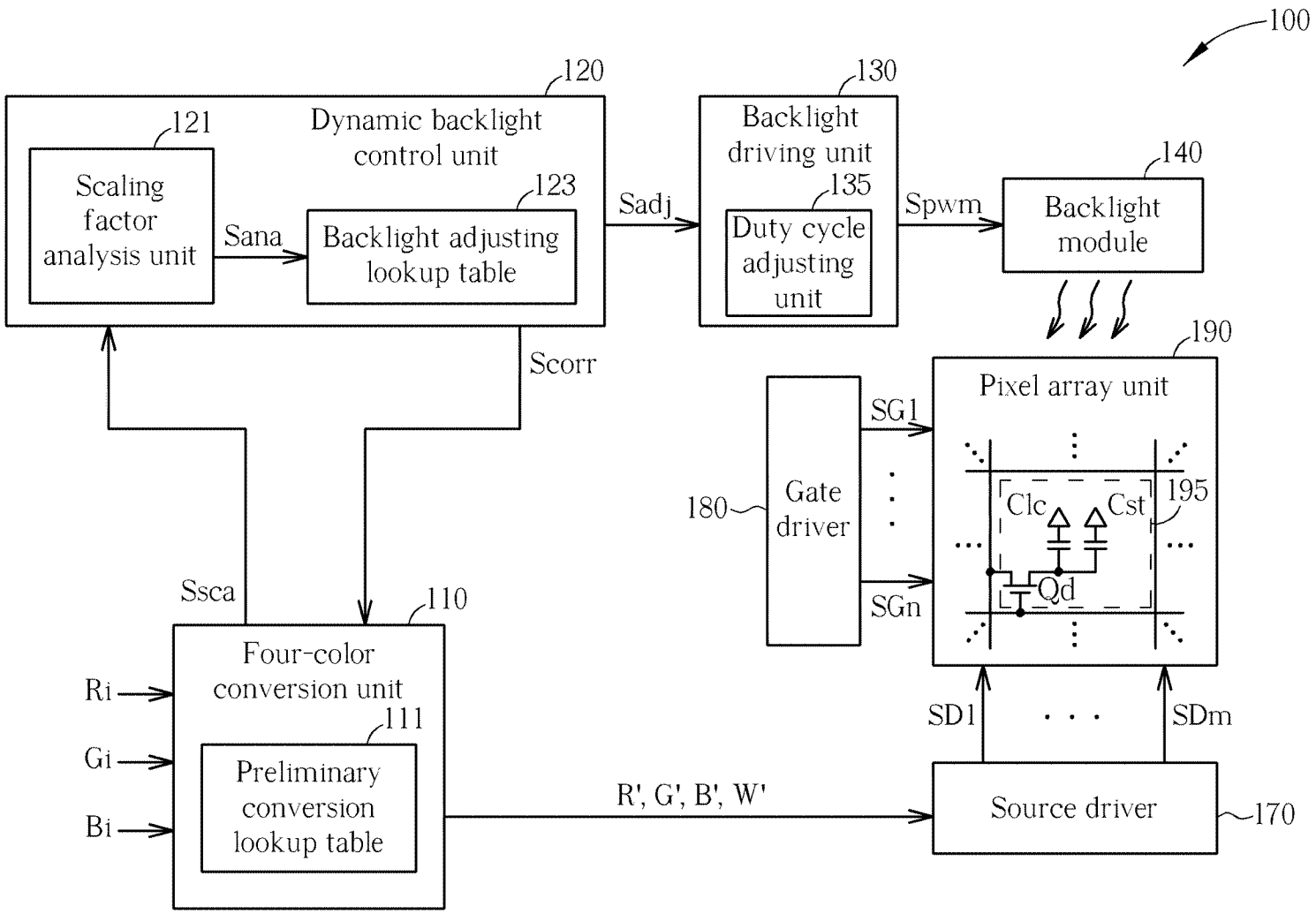
FIG. 1 is a structural diagram schematically showing a flat panel display in accordance with a first embodiment of the present invention.

FIG. 1 is a structural diagram schematically showing a flat panel display 100 in accordance with a first embodiment of the present invention. As shown in FIG. 1, the flat panel display 100 comprises a four-color conversion unit 110, a dynamic backlight control unit 120, a backlight driving unit 130, a backlight module 140, a source driver 170, a gate driver 180, and a pixel array unit 190. The pixel array unit 190 comprises a plurality of pixel units 195. Each pixel unit 195 includes a data switch Qd, a liquid crystal capacitor Clc, and a storage capacitor Cst. The source driver 170 is employed to provide plural data signals SD1~SDm. The gate driver 180 is employed to provide plural gate signals SG1~SGn for controlling related writing operations of the data signals SD1~SDm. And the pixel array unit 190 is put in use for displaying an image according to the data signals SD1~SDm in coordination with a backlight output provided by the backlight module 140.

The four-color conversion unit 110, electrically connected to the dynamic backlight control unit 120 and the source driver 170, is utilized for converting three color image input signals Ri, Gi, Bi into four color image signals having a white-color image signal. The four-color conversion unit 110 includes a preliminary conversion lookup table 111 which is utilized for providing a first set of four color image signals corresponding to the three color image input signals Ri, Gi, Bi. That is, the preliminary conversion lookup table 111 provides a mapping relationship between the three color image input signals Ri, Gi, Bi and the first set of four color image signals. The four-color conversion unit 110 is further employed to provide a plurality of conversion scaling factors Ssca corresponding to the conversion of the three color image input signals Ri, Gi, Bi into the first set of four color image signals. The conversion scaling factors Ssca are forwarded to the dynamic backlight control unit 120. In one embodiment, the conversion scaling factor Ssca of each set of three color image input signals Ri, Gi, Bi is determined according to whether the set of three color image input signals Ri, Gi, Bi is a pure color or close to a pure color and/or according to the brightness thereof. For instance, if a set of three color image input signals Ri, Gi, Bi is employed to display a blue color, which is one of three primitive colors and both the values of the signals Ri and Gi are zero, the corresponding conversion scaling factor Ssca can be set to zero.

The dynamic backlight control unit 120 includes a scaling factor analysis unit 121 and a backlight adjusting lookup table 123. The scaling factor analysis unit 121 functions to generate an analysis value Sana through analyzing the conversion scaling factors Ssca corresponding to plural sets of three color image input signals Ri, Gi, Bi of each frame. In one embodiment, the scaling factor analysis unit 121 is employed to perform a statistical operation on the conversion scaling factors Ssca corresponding to the sets of three color image input signals Ri, Gi, Bi of each frame for providing plural counting values. Each of the counting values is corresponding to one conversion scaling factor Ssca. And an accumulation value is calculated through adding the counting values sequentially following an incremental order of the conversion scaling factors Ssca until the accumulation value approximates a preset value. Then, the greatest conversion scaling factor Ssca of the conversion scaling factors Ssca with the corresponding counting values being added is fetched, and the backlight output of the backlight module 140 is adjusted to be greater as the greatest conversion scaling factor Ssca is smaller. It is noted that the preset value can be the number of a preset percentage of total frame pixels, e.g. the number of 20% of total frame pixels.

The backlight adjusting lookup table 123 is used to provide a backlight adjusting signal Sadj corresponding to the analysis value Sana. That is, the backlight adjusting lookup table 123 provides a mapping relationship between the analysis value Sana and the backlight adjusting signal Sadj. In other words, the dynamic backlight control unit 120 is employed to provide the backlight adjusting signal Sadj corresponding to an analysis result of analyzing the conversion scaling factors Ssca by the scaling factor analysis unit 121. The dynamic backlight control unit 120 is further employed to generate a conversion correction signal Scorr according to the backlight adjusting signal Sadj. The conversion correction signal Scorr is furnished to the four-color conversion unit 110, and the four-color conversion unit 110 is further utilized for generating a corrected conversion lookup table according to the conversion correction signal Scorr and the preliminary conversion lookup table 111. Moreover, the four-color conversion unit 110 employs the corrected conversion lookup table to provide a second set of four color image signals R', G', B', W' corresponding to the three color image input signals Ri, Gi, Bi. It is noted that W' represents a white-color image signal. The second set of four color image signals R', G', B', W' is forwarded to the source driver 170 for generating the data signals SD1~SDm accordingly. The backlight driving unit 130, electrically connected between the dynamic backlight control unit 120 and the backlight module 140, employs the backlight adjusting signal Sadj to generate a pulse width modulation (PWM) signal Spwm for driving the backlight module 140 to emit a desirable backlight output. The backlight driving unit 130 includes a duty cycle adjusting unit 135 for adjusting the duty cycle of the PWM signal Spwm according to the backlight adjusting signal Sadj.

In one embodiment, regarding the image signals of each frame to be displayed, if the quantity of image signals which are pure colors or close to pure colors is greater, i.e. the quantity of the conversion scaling factors Ssca less than a predetermined threshold is greater, the backlight adjusting signal Sadj provided by the backlight adjusting lookup table 123 is also greater for enhancing the backlight output of the backlight module 140. Further, the image signal which is neither a pure color nor close to a pure color is adjusted according to the backlight adjusting signal Sadj. However, the adjustment of the image signal which is a pure color or close to a pure color is optional. In another embodiment, the backlight adjusting signal Sadj is roughly proportional to the quantity of image signals which are pure colors or close to pure colors, and the increase of the backlight output is roughly proportional to the backlight adjusting signal Sadj. Also, the conversion correction signal Scorr is roughly proportional to the backlight adjusting signal Sadj. That is, the decrease of the image signal which is neither a pure color nor close to a pure color is roughly proportional to the increase of the backlight output.

In summary, the flat panel display 100 enhances the backlight output according to the quantity of image signals which are pure colors or close to pure colors, and lowers the value of the image signal which is neither a pure color nor close to a pure color according to the increase of the backlight output, for achieving high reproducibility of images displayed based on four color image signals.

Figure 2:
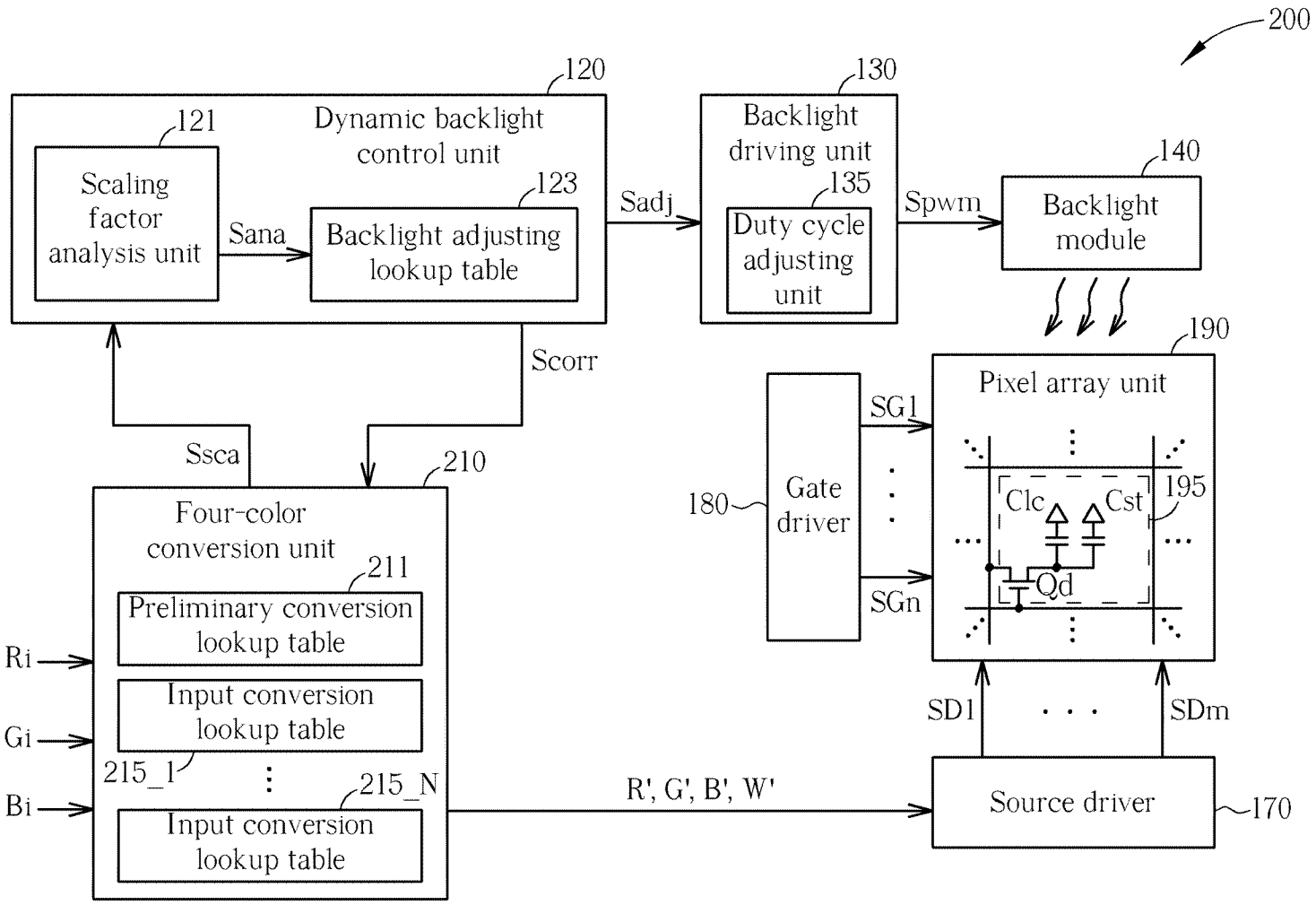
FIG. 2 is a structural diagram schematically showing a flat panel display in accordance with a second embodiment of the present invention.

FIG. 2 is a structural diagram schematically showing a flat panel display 200 in accordance with a second embodiment of the present invention. As shown in FIG. 2, the structure of the flat panel display 200 is similar to that of the flat panel display 100 shown in FIG. 1, differing in that the four-color conversion unit 110 is replaced with a four-color conversion unit 210. The four-color conversion unit 210 includes a preliminary conversion lookup table 211 and a plurality of input conversion lookup tables 215_1~215_N. The functionality of the preliminary conversion lookup table 211 is substantially identical to that of the preliminary conversion lookup table 111 shown in FIG. 1 and, for the sake of brevity, further similar discussion thereof is omitted. After the four-color conversion unit 210 receives the conversion correction signal Scorr from the dynamic backlight control unit 120, the four-color conversion unit 210 will select one corresponding input conversion lookup table out of the input conversion lookup tables 215_1~215_N according to the conversion correction signal Scorr. The corresponding input conversion lookup table selected is then utilized for providing the second set of four color image signals R', G', B', W' corresponding to the three color image input signals Ri, Gi, Bi. In comparison with the four-color conversion unit 110, the four-color conversion unit 210 is not required to perform related calculation operations for generating the aforementioned corrected conversion lookup table according to the conversion correction signal Scorr and the preliminary conversion lookup table 111, for enhancing signal processing speed.

Figure 3:
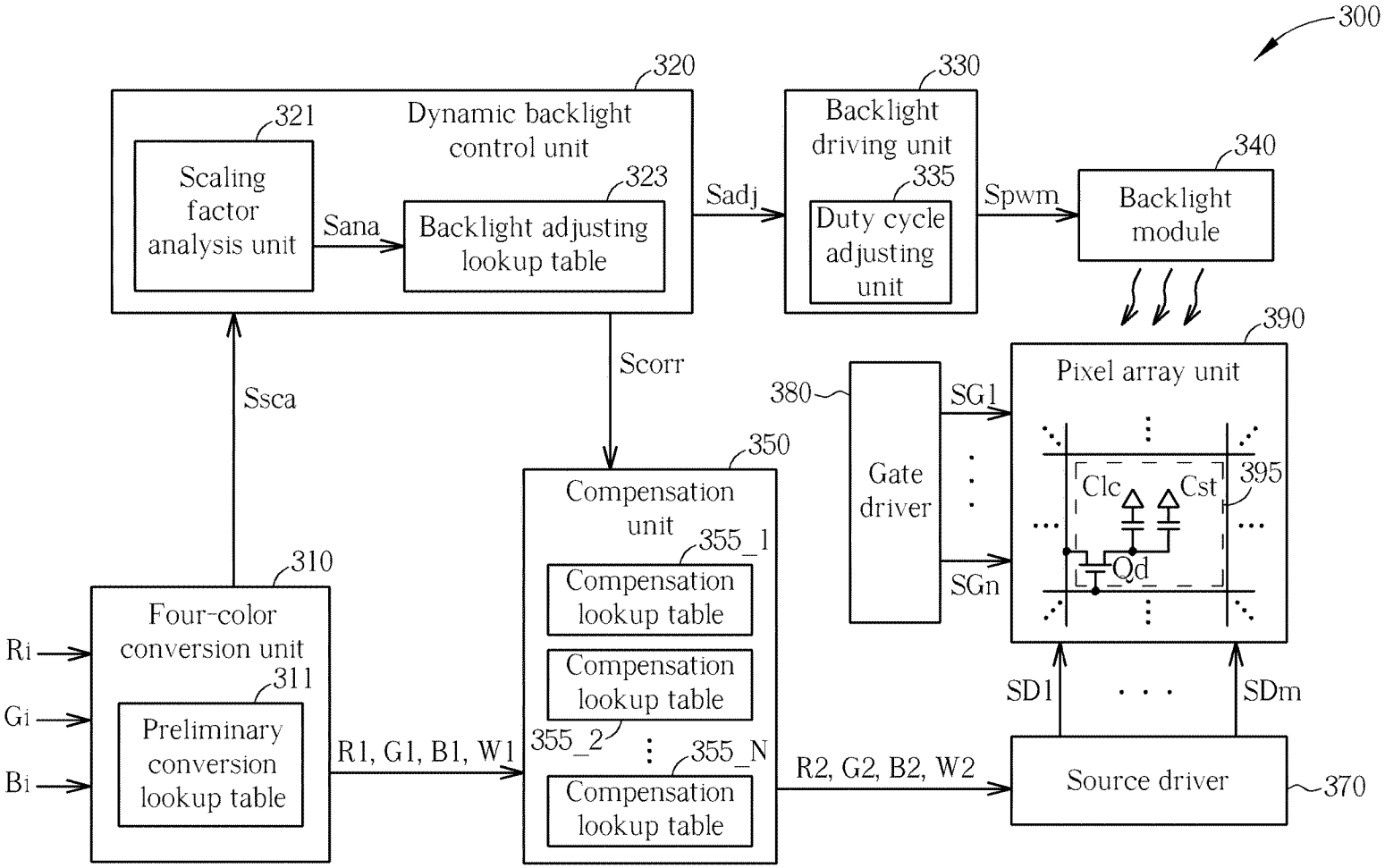
FIG. 3 is a structural diagram schematically showing a flat panel display in accordance with a third embodiment of the present invention.

FIG. 3 is a structural diagram schematically showing a flat panel display 300 in accordance with a third embodiment of the present invention. As shown in FIG. 3, the flat panel display 300 comprises a four-color conversion unit 310, a dynamic backlight control unit 320, a backlight driving unit 330, a backlight module 340, a compensation unit 350, a source driver 370, a gate driver 380, and a pixel array unit 390. The pixel array unit 390 comprises a plurality of pixel units 395. Each pixel unit 395 includes a data switch Qd, a liquid crystal capacitor Clc, and a storage capacitor Cst. The source driver 370 is employed to provide plural data signals SD1~SDm. The gate driver 380 is employed to provide plural gate signals SG1~SGn for controlling related writing operations of the data signals SD1~SDm. And the pixel array unit 390 is put in use for displaying an image according to the data signals SD1~SDm in coordination with a backlight output provided by the backlight module 340.

The four-color conversion unit 310, electrically connected to the dynamic backlight control unit 320 and the compensation unit 350, is utilized for converting three color image input signals Ri, Gi, Bi into a first set of four color image signals R1, G1, B1, W1, where W1 represents a white-color image signal. The four-color conversion unit 310 includes a preliminary conversion lookup table 311 for providing the first set of four color image signals R1, G1, B1, W1 corresponding to the three color image input signals Ri, Gi, Bi. That is, the preliminary conversion lookup table 311 provides a mapping relationship between the three color image input signals Ri, Gi, Bi and the first set of four color image signals R1, G1, B1, W1. The first set of four color image signals R1, G1, B1, W1 is delivered to the compensation unit 350. The four-color conversion unit 310 is further employed to provide a plurality of conversion scaling factors Ssca corresponding to the conversion of the three color image input signals Ri, Gi, Bi into the first set of four color image signals R1, G1, B1, W1. The conversion scaling factors Ssca are forwarded to the dynamic backlight control unit 320.

The dynamic backlight control unit 320 includes a scaling factor analysis unit 321 and a backlight adjusting lookup table 323. The scaling factor analysis unit 321 functions to analyze the conversion scaling factors Ssca for generating an analysis value Sana. And the backlight adjusting lookup table 323 is used to provide a backlight adjusting signal Sadj corresponding to the analysis value Sana. That is, the backlight adjusting lookup table 323 provides a mapping relationship between the analysis value Sana and the backlight adjusting signal Sadj. The dynamic backlight control unit 320 is further employed to generate a conversion correction signal Scorr according to the backlight adjusting signal Sadj. The conversion correction signal Scorr is furnished to the compensation unit 350.

The compensation unit 350 includes a plurality of compensation lookup tables 355_1~355_N. After the compensation unit 350 receives the conversion correction signal Scorr from the dynamic backlight control unit 320, the compensation unit 350 will select one corresponding compensation lookup table out of the compensation lookup tables 355_1~355_N according to the conversion correction signal Scorr. The corresponding compensation lookup table selected is then utilized for compensating the first set of four color image signals R1, G1, B1, W1 to become a second set of four color image signals R2, G2, B2, W2. The second set of four color image signals R2, G2, B2, W2 is forwarded to the source driver 370 for generating the data signals SD1~SDm accordingly. The backlight driving unit 330, electrically connected between the dynamic backlight control unit 320 and the backlight module 340, employs the backlight adjusting signal Sadj to generate a pulse width modulation (PWM) signal Spwm for driving the backlight module 340 to emit a desirable backlight output. The backlight driving unit 330 includes a duty cycle adjusting unit 335 for adjusting the duty cycle of the PWM signal Spwm according to the backlight adjusting signal Sadj.

In one embodiment, regarding the image signals of each frame to be displayed, if the quantity of image signals which are pure colors or close to pure colors is greater, i.e. the quantity of the conversion scaling factors Ssca less than a predetermined threshold is greater, the backlight adjusting signal Sadj provided by the backlight adjusting lookup table 323 is also greater for enhancing the backlight output of the backlight module 340. Further, the image signal which is neither a pure color nor close to a pure color is compensated according to the backlight adjusting signal Sadj. However, the compensation of the image signal which is a pure color or close to a pure color is optional. In another embodiment, the backlight adjusting signal Sadj is roughly proportional to the quantity of image signals which are pure colors or close to pure colors, and the increase of the backlight output is roughly proportional to the backlight adjusting signal Sadj. Also, the conversion correction signal Scorr is roughly proportional to the backlight adjusting signal Sadj. That is, the compensation of the image signal which is neither a pure color nor close to a pure color is roughly proportional to the increase of the backlight output.

In summary, the flat panel display 300 enhances the backlight output according to the quantity of image signals which are pure colors or close to pure colors, and compensates the value of the image signal which is neither a pure color nor close to a pure color according to the increase of the backlight output, for achieving high reproducibility of images displayed based on four color image signals.

Figure 4:
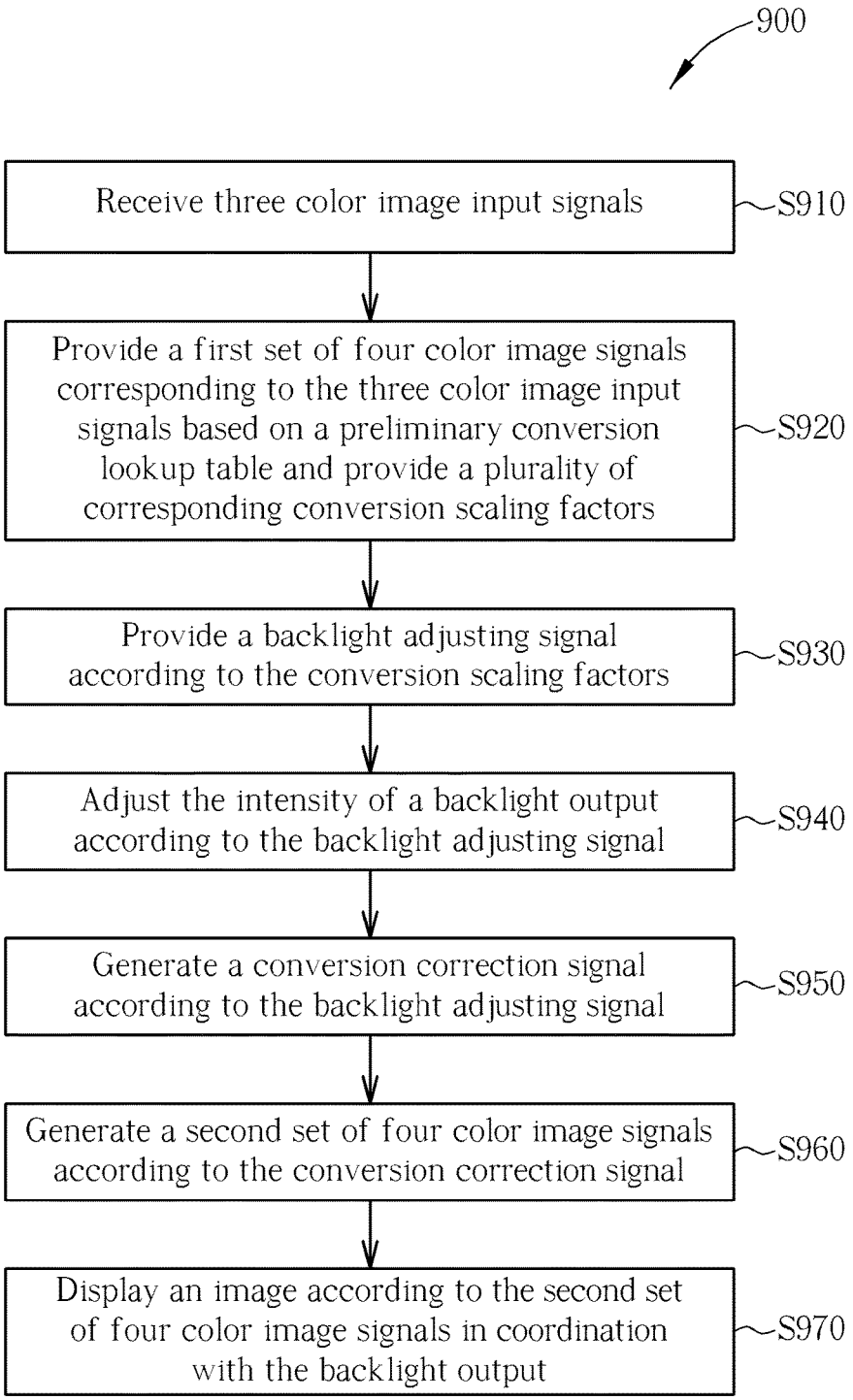
FIG. 4 is a flowchart depicting an image display method for use in a flat panel display according to a preferred embodiment of the present invention.

FIG. 4 is a flowchart depicting an image display method for use in a flat panel display according to a preferred embodiment of the present invention. The image display method regarding the flow 900 shown in FIG. 4 is implemented based on the flat panel display 100 shown in FIG. 1, the flat panel display 200 shown in FIG. 2, or the flat panel display 300 shown in FIG. 3. The image display method illustrated in the flow 900 comprises the following steps:

Step S910: receiving three color image input signals;

Step S920: providing a first set of four color image signals corresponding to the three color image input signals based on a preliminary conversion lookup table and providing a plurality of corresponding conversion scaling factors;

Step S930: providing a backlight adjusting signal according to the conversion scaling factors;

Step S940: adjusting the intensity of a backlight output according to the backlight adjusting signal;

Step S950: generating a conversion correction signal according to the backlight adjusting signal;

Step S960: generating a second set of four color image signals according to the conversion correction signal; and Step S970: displaying an image according to the second set of four color image signals in coordination with the backlight output.

In the flow 900 of the image display method, each set of four color image signals may comprise a white-color image signal. If the image display method disclosed in the flow 900 is implemented based on the flat panel display 100 shown in FIG. 1, the step S960 of generating the second set of four color image signals according to the conversion correction signal comprises: generating a corrected conversion lookup table according to the conversion correction signal and the preliminary conversion lookup table; and providing the second set of four color image signals corresponding to the three color image input signals based on the corrected conversion lookup table. If the image display method disclosed in the flow 900 is implemented based on the flat panel display 200 shown in FIG. 2, the step S960 of generating the second set of four color image signals according to the conversion correction signal comprises: selecting one corresponding input conversion lookup table out of plural input conversion lookup tables according to the conversion correction signal; and providing the second set of four color image signals corresponding to the three color image input signals based on the corresponding input conversion lookup table selected. If the image display method disclosed in the flow 900 is implemented based on the flat panel display 300 shown in FIG. 3, the step S960 of generating the second set of four color image signals according to the conversion correction signal comprises: selecting one corresponding compensation lookup table out of plural compensation lookup tables according to the conversion correction signal; and compensating the first set of four color image signals to become the second set of four color image signals based on the corresponding compensation lookup table selected.

The step S930 of providing the backlight adjusting signal according to the conversion scaling factors comprises: analyzing the conversion scaling factors for generating a corresponding analysis value; and providing the backlight adjusting signal according to the analysis value. In one embodiment, the analysis value is a quantity of the conversion scaling factors less than a predetermined threshold, i.e. the analysis value can be the quantity of the image signals which are pure colors or close to pure colors. The step S940 of adjusting the intensity of the backlight output according to the backlight adjusting signal comprises: adjusting the duty cycle of a pulse width modulation signal according to the backlight adjusting signal; and providing the backlight output according to the pulse width modulation signal. In one embodiment, the increase of the duty cycle is roughly proportional to the backlight adjusting signal, i.e. the increase of the backlight output is roughly proportional to the quantity of the image signals which are pure colors or close to pure colors.

In conclusion, the flat panel display of the present invention enhances backlight output according to the quantity of image signals which are pure colors or close to pure colors, and lowers the value of the image signal which is neither a pure color nor close to a pure color according to the increase of backlight output, for achieving high reproducibility of images displayed based on four color image signals.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. A flat panel display comprising:

a four-color conversion unit comprising a preliminary conversion lookup table, the four-color conversion unit being utilized for providing a first set of four color image signals corresponding to three color image input signals based on the preliminary conversion lookup table and providing a plurality of corresponding conversion scaling factors;

a dynamic backlight control unit, electrically connected to the four-color conversion unit, for a backlight adjusting signal according to the conversion scaling factors, wherein the four-color conversion unit is further utilized for converting the three color image input signals into a second set of four color image signals according to the backlight adjusting signal;

a backlight module, electrically connected to the dynamic backlight control unit, for providing a backlight output having an intensity adjusted according to the backlight adjusting signal;

a source driver, electrically connected to the four-color conversion unit, for providing a plurality of data signals according to the second set of four color image signals; and a pixel array unit, electrically connected to the source driver, for displaying an image according to the data signals and the backlight output.

2. The flat panel display of claim 1, further comprising:

a backlight driving unit, electrically connected between the dynamic backlight control unit and the backlight module, for generating a pulse width modulation signal according to the backlight adjusting signal, the pulse width modulation signal being employed to drive the backlight module.

3. The flat panel display of claim 2, wherein the backlight driving unit comprises:

a duty cycle adjusting unit for adjusting a duty cycle of the pulse width modulation signal according to the backlight adjusting signal.

4. The flat panel display of claim 1, wherein the dynamic backlight control unit comprises:

a scaling factor analysis unit for generating an analysis value through analyzing the conversion scaling factors; and a backlight adjusting lookup table for providing the backlight adjusting signal corresponding to the analysis value.

5. The flat panel display of claim 1, wherein the dynamic backlight control unit is further utilized for providing a conversion correction signal according to the backlight adjusting signal, and wherein the four-color conversion unit further comprises:

a plurality of input conversion lookup tables, the four-color conversion unit selecting a corresponding input conversion lookup table out of the input conversion lookup tables according to the conversion correction signal and providing the second set of four color image signals corresponding to the three color image input signals based on the corresponding input conversion lookup table.

6. The flat panel display of claim 1, wherein the dynamic backlight control unit is further utilized for providing a conversion correction signal according to the backlight adjusting signal, and wherein the four-color conversion unit is further employed to generate a corrected conversion lookup table according to the preliminary conversion lookup table and the conversion correction signal, and the four-color conversion unit provides the second set of four color image signals corresponding to the three color image input signals based on the corrected conversion lookup table.

7. The flat panel display of claim 1, further comprising:

a gate driver, electrically connected to the pixel array unit, for providing a plurality of gate signals to control writing operations of the data signals.

8. The flat panel display of claim 1, wherein the pixel array unit displays the image according to the data signals in coordination with the backlight output.

9. A flat panel display comprising:

a four-color conversion unit comprising a preliminary conversion lookup table, the four-color conversion unit being utilized for providing a first set of four color image signals corresponding to three color image input signals based on the preliminary conversion lookup table and providing a plurality of corresponding conversion scaling factors;

a dynamic backlight control unit, electrically connected to the four-color conversion unit, for a backlight adjusting signal according to the conversion scaling factors;

a compensation unit, electrically connected to the four-color conversion unit and the dynamic backlight control unit, for compensating the first set of four color image signals to become a second set of four color image signals according to the backlight adjusting signal;

a backlight module, electrically connected to the dynamic backlight control unit, for providing a backlight output having an intensity adjusted according to the backlight adjusting signal;

a source driver, electrically connected to the compensation unit, for providing a plurality of data signals according to the second set of four color image signals; and a pixel array unit, electrically connected to the source driver, for displaying an image according to the data signals and the backlight output.

10. The flat panel display of claim 9, wherein the dynamic backlight control unit is further utilized for providing a conversion correction signal according to the backlight adjusting signal, and wherein the compensation unit comprises:

a plurality of compensation lookup tables, the compensation unit selecting a corresponding compensation lookup table out of the compensation lookup tables according to the conversion correction signal and compensating the first set of four color image signals to become the second set of four color image signals based on the corresponding compensation lookup table.

11. The flat panel display of claim 9, further comprising:

a backlight driving unit, electrically connected between the dynamic backlight control unit and the backlight module, for generating a pulse width modulation signal according to the backlight adjusting signal, the pulse width modulation signal being employed to drive the backlight module.

12. The flat panel display of claim 11, wherein the backlight driving unit comprises:

a duty cycle adjusting unit for adjusting a duty cycle of the pulse width modulation signal according to the backlight adjusting signal.

13. The flat panel display of claim 9, wherein the dynamic backlight control unit comprises:

a scaling factor analysis unit for generating an analysis value through analyzing the conversion scaling factors; and a backlight adjusting lookup table for providing the backlight adjusting signal corresponding to the analysis value.

14. The flat panel display of claim 9, wherein the pixel array unit displays the image according to the data signals in coordination with the backlight output.

15. An image display method for use in a flat panel display, the image display method comprising:

receiving a set of three color image input signals;

providing a first set of four color image signals corresponding to the set of three color image input signals based on a preliminary conversion lookup table and providing a plurality of corresponding conversion scaling factors;

providing a backlight adjusting signal according to the conversion scaling factors;

adjusting an intensity of a backlight output according to the backlight adjusting signal;

generating a second set of four color image signals according to the backlight adjusting signal; and displaying an image according to the second set of four color image signals in coordination with the backlight output.

16. The image display method of claim 15, wherein the step of generating the second set of four color image signals according to the backlight adjusting signal comprises:

generating a conversion correction signal according to the backlight adjusting signal;

generating a corrected conversion lookup table according to the conversion correction signal and the preliminary conversion lookup table; and providing the second set of four color image signals corresponding to the set of three color image input signals based on the corrected conversion lookup table.

17. The image display method of claim 15, wherein the step of generating the second set of four color image signals according to the backlight adjusting signal comprises:

generating a conversion correction signal according to the backlight adjusting signal;

selecting a corresponding input conversion lookup table out of plural input conversion lookup tables according to the conversion correction signal; and providing the second set of four color image signals corresponding to the set of three color image input signals based on the corresponding input conversion lookup table.

18. The image display method of claim 15, wherein the step of generating the second set of four color image signals according to the backlight adjusting signal comprises:

generating a conversion correction signal according to the backlight adjusting signal;

selecting a corresponding compensation lookup table out of plural compensation lookup tables according to the conversion correction signal; and compensating the first set of four color image signals to become the second set of four color image signals based on the corresponding compensation lookup table.

19. The image display method of claim 15, wherein the step of adjusting the intensity of the backlight output according to the backlight adjusting signal comprises:

adjusting a duty cycle of a pulse width modulation signal according to the backlight adjusting signal; and providing the backlight output according to the pulse width modulation signal.

20. The image display method of claim 15, wherein the step of providing the backlight adjusting signal according to the conversion scaling factors comprises:

analyzing the conversion scaling factors for generating an analysis value; and providing the backlight adjusting signal according to the analysis value.

21. The image display method of claim 20, wherein the analysis value is a quantity of the conversion scaling factors less than a threshold.

* * * * *